US009380664B2

(12) United States Patent
Scheidegger et al.

(10) Patent No.: US 9,380,664 B2
(45) Date of Patent: Jun. 28, 2016

(54) MICROCONTROLLER BURST MODE TO MAINTAIN VOLTAGE SUPPLY DURING STANDBY MODE OF A LIGHTING SYSTEM

(71) Applicant: General Electric Company, Schenectady, NY (US)

(72) Inventors: Nina Rose Scheidegger, East Cleveland, OH (US); Carre Denise Scheidegger, East Cleveland, OH (US); Gang Yao, East Cleveland, OH (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 14/519,846

(22) Filed: Oct. 21, 2014

(65) Prior Publication Data

US 2016/0113078 A1 Apr. 21, 2016

(51) Int. Cl.
*H05B 33/08* (2006.01)
*H05B 35/00* (2006.01)

(52) U.S. Cl.
CPC ..... *H05B 33/0818* (2013.01); *H05B 35/00* (2013.01)

(58) Field of Classification Search
CPC ..... H05B 33/0818; H05B 33/0833
USPC ..... 315/210
See application file for complete search history.

(56) References Cited

U.S. PATENT DOCUMENTS

2007/0262652 A1 11/2007 Kilroy
2014/0049186 A1* 2/2014 Fortini ..... H05B 33/0845 315/250
2014/0346874 A1* 11/2014 Fang ..... H02M 3/33523 307/31
2015/0207421 A1* 7/2015 Ryu ..... H02M 7/068 315/193

FOREIGN PATENT DOCUMENTS

EP 2549653 A2 1/2013
EP 2670223 * 4/2013 ..... H05B 37/02
WO 02082618 A1 10/2002

OTHER PUBLICATIONS

PCT Search Report and Written Opinion issued in connection with corresponding Application No. PCT/US2015/049106 on Dec. 11, 2015.

* cited by examiner

*Primary Examiner* — Dylan White
(74) *Attorney, Agent, or Firm* — GE Global Patent Operation; Peter T. DiMauro

(57) ABSTRACT

Provided is a lighting system that includes a plurality of lighting elements which emit light, a power supply which supplies power, a lighting driver comprising a microcontroller and which outputs power to the plurality of lighting elements for operation thereof; and a control system which transmits a control signal to the microcontroller to initiate a standby mode of the plurality of lighting elements. The microcontroller receives the control signal and decreases output power supplied to the plurality of lighting elements, while remaining in a low power consumption mode for communicating with the control system during standby mode.

16 Claims, 4 Drawing Sheets

MICROCONTROLLER BURST MODE TO MAINTAIN VOLTAGE SUPPLY DURING STANDBY MODE OF A LIGHTING SYSTEM

TECHNICAL FIELD

The technical field relates generally to a lighting control system. In particularly, a method of maintaining sufficient power to a microcontroller of a lighting (LED) driver, in order to facilitate receiving and transmitting of messages between the lighting control system and the microcontroller during standby mode of the lighting system.

BACKGROUND

A lighting system e.g., a digital addressable lighting interface ("DALI") system, includes a control system for controlling an operation of a plurality of lighting elements (E.g., luminaires) via a lighting driver including a microcontroller for controlling the plurality of lighting elements based on control signals received from the control system. The control system controls various operating modes of the lighting elements such as on/off and standby/sleep mode. During standby/sleep mode, the control system sends a control signal to the microcontroller of the lighting driver, to turn the lighting elements off, and the lighting driver goes into a low power consumption mode.

While the lighting elements are in standby/sleep mode, it is necessary for the microcontroller to receive sufficient power in order to continue to receive messages from and transmit messages to the control system. If sufficient power is not supplied to the microcontroller, messages may not be transmitted or received from the control system, thereby causing undesired operational issues within the lighting system and possible failure to meet lighting communication standards (e.g. DALI).

SUMMARY OF THE EMBODIMENTS

The various embodiments of the present disclosure are configured to provide a lighting system and a method for maintaining power supply to the microcontroller by performing periodic bursts of power thereto during the standby/sleep mode of the lighting element, in order to increase the power supply to the microcontroller and thereby allow continued communications (receiving and transmitting of messages) between the microcontroller and the control system.

In one exemplary embodiment, a lighting system is provided. The lighting system comprising a plurality of lighting elements configured to emit light, a power supply configured to supply power, a lighting driver comprising a microcontroller and configured to output power to the plurality of lighting elements for operation thereof; and a control system configured to transmit a control signal to the microcontroller to initiate a standby mode of the plurality of lighting elements, wherein the microcontroller is configured to receive the control signal and decrease output power supplied to the plurality of lighting elements, while remaining in a low power consumption mode for communicating with the control system during standby mode.

In another exemplary embodiment, a method is provided. The method comprising outputting power to a plurality of lighting elements within a lighting system; transmitting a control signal from a control system to a microcontroller of a lighting driver, to initiate the standby mode; initiating the standby mode by decreasing, via the microcontroller, the power to the plurality of lighting elements while remaining in a low power consumption mode for communicating with the control system during standby mode.

The foregoing has broadly outlined some of the aspects and features of various embodiments, which should be construed to be merely illustrative of various potential applications of the disclosure. Other beneficial results can be obtained by applying the disclosed information in a different manner or by combining various aspects of the disclosed embodiments. Accordingly, other aspects and a more comprehensive understanding may be obtained by referring to the detailed description of the exemplary embodiments taken in conjunction with the accompanying drawings, in addition to the scope defined by the claims.

Figure 1:
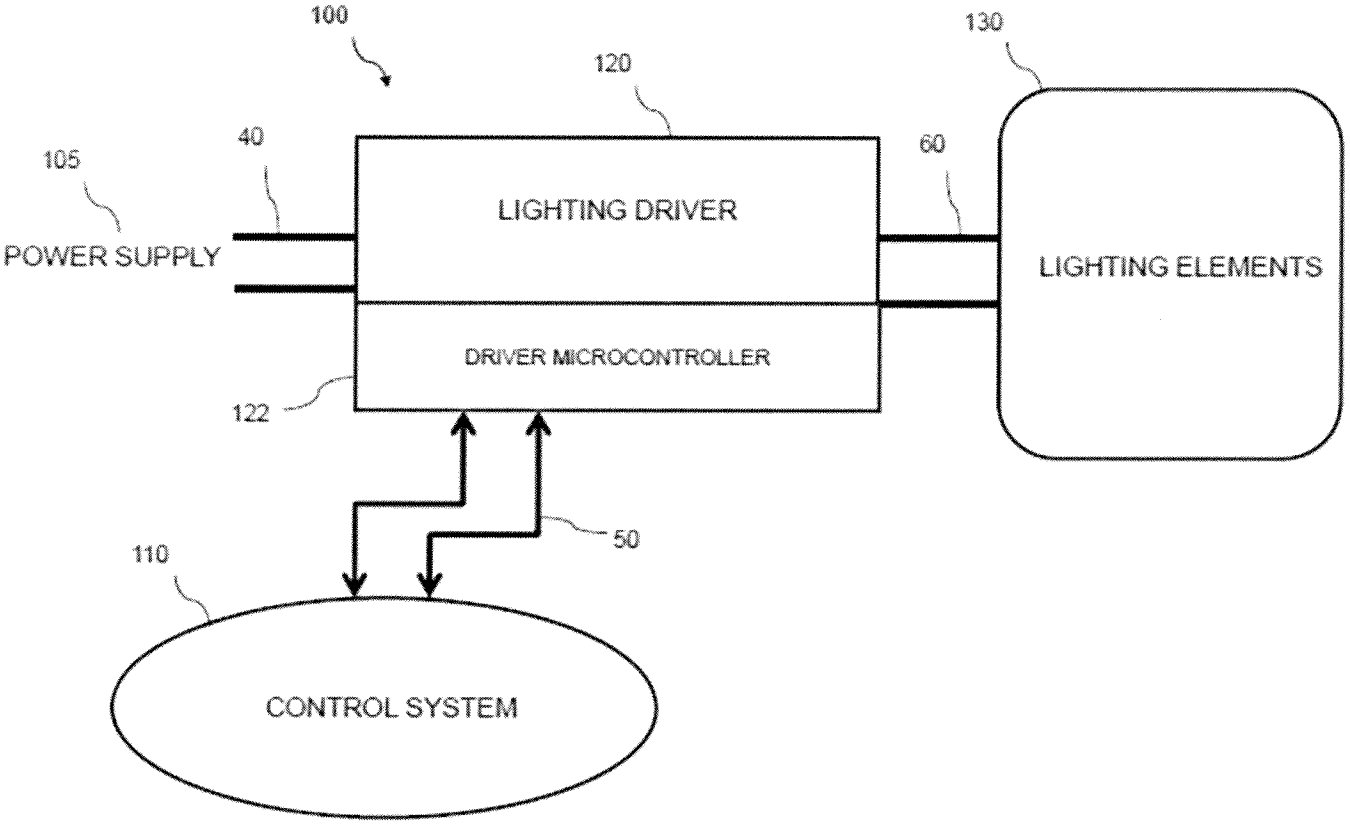
FIG. 1 is schematic illustration of a lighting system according to one or more exemplary embodiments.

The drawings are only for purposes of illustrating preferred embodiments and are not to be construed as limiting the disclosure. Given the following enabling description of the drawings, the novel aspects of the present disclosure should become evident to a person of ordinary skill in the art. This detailed description uses numerical and letter designations to refer to features in the drawings. Like or similar designations in the drawings and description have been used to refer to like or similar parts of embodiments of the invention.

DETAILED DESCRIPTION OF THE EMBODIMENTS

As required, detailed embodiments are disclosed herein. It must be understood that the disclosed embodiments are merely exemplary of various and alternative forms. As used herein, the word "exemplary" is used expansively to refer to embodiments that serve as illustrations, specimens, models, or patterns. The figures are not necessarily to scale and some features may be exaggerated or minimized to show details of particular components. In other instances, well-known components, systems, materials, or methods that are known to those having ordinary skill in the art have not been described in detail in order to avoid obscuring the present disclosure. Therefore, specific structural and functional details disclosed herein are not to be interpreted as limiting, but merely as a basis for the claims and as a representative basis for teaching one skilled in the art.

Exemplary embodiments of the present invention provide a lighting system and method for maintaining voltage supply to a microcontroller of a lighting driver in a lighting system, to continue to receive and transmit signals (i.e., messages) to and from a control system of the lighting system during standby mode thereof.

FIG. 1 is schematic illustration of a lighting system 100 according to one or more exemplary embodiments.

The lighting system 100 comprises a power supply 105, a control system 110, a lighting driver 120, and a plurality of lighting elements 130.

The lighting system 100 may be a digital addressable lighting interface (DALI) system or any other type of lighting system suitable for implementation of the exemplary embodiments shown in FIGS. 1 through 4.

According to one or more embodiments, the power supply 105 is configured to supply an alternate current (AC) power supply to the lighting driver 120 for operating the lighting elements 130 via wires 40. The power supply 105 is internal to the lighting system 100. The power supply 105 may be of a range of 120 volts (V) to approximately 277 volts (V). The present invention is not limited to any particular power supply and therefore the power supply may be varied as necessary.

According to one or more embodiments, the control system 110 may be a DALI control system or any other suitable type of control system for the purposes set forth herein. The control system 110 is configured to control the lighting driver 120 by sending a control signal thereto, for controlling the various operations of the lighting elements 130, for example, dimming modes, standby/sleep mode, and driver queries. The lighting driver 120 (e.g., an Lighting driver), comprises a microcontroller 122 for receiving control signals (i.e., messages) from the control system 110 and acting upon the control signals by controlling the lighting driver 120 to operate the lighting elements 130 when needed, and transmitting messages to the control system 110 via wires 50. The microcontroller 122 may be programmable or hardwired. The lighting driver 120 converts the ac power supply 105 voltage and current to a constant voltage or constant current source for the lighting elements 130 via wires 60. Further, a current sensor of the overall lighting system 100 and a current converter for converting the power (in the form of input current) received from the power supply 105 into a lighting source current for supplying power to the lighting elements 130 via wires 60 may be provided.

Further, the lighting (LED) driver 120 comprises of circuit 125 that during standby/sleep mode powers microcontroller 122 and reduces power consumption of the lighting driver 120 when in standby/sleep mode. Accordingly, the output current levels to the lighting driver 120 may be adjusted as needed based on commands received by the microcontroller 122 from control system 110. When the microcontroller 122 receives an off or standby control signal from the controls system 110, the microcontroller 122 controls different components within the circuit 125 to turn the lighting elements 130 to the off mode or standby/sleep mode and puts the lighting driver 120 into a low power consumption mode.

According to one or more exemplary embodiments, the lighting driver 120 may comprises additional components for monitoring and enhancing operation of the lighting elements 130, for example, a temperature sensor for sensing temperature related to the lighting elements 130.

The lighting elements 130 may be light-emitting diodes (LEDs) such as semiconductor, organic or polymeric LEDs or similar devices. The lighting elements 130 are configured to receive output power from the lighting driver 120 and to emit light as controlled.

A detailed description of a control operation of the lighting driver 120 and the microcontroller 122 for maintaining sufficient voltage supply at the microcontroller 122 during standby mode of the lighting system, will now be described below with reference to FIGS. 2 through 4.

Figure 2:
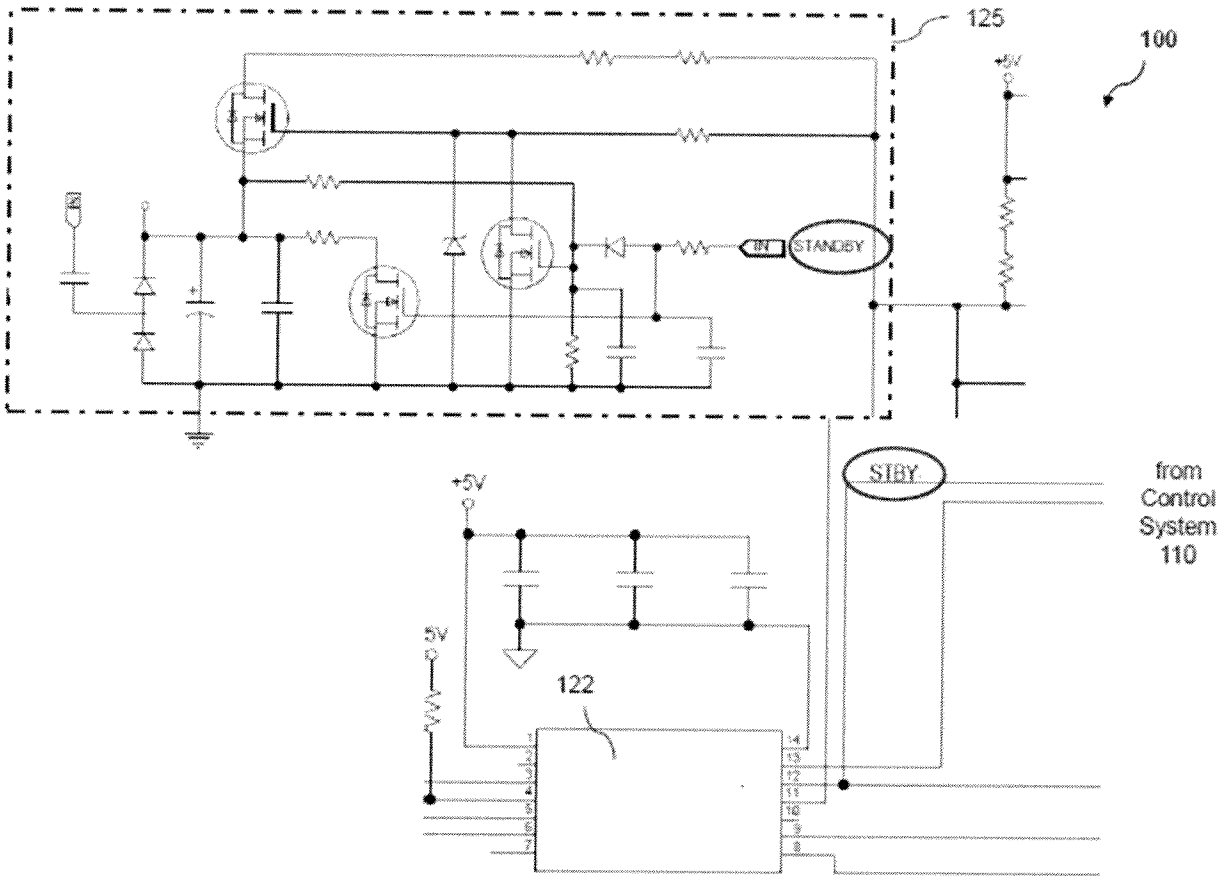
FIG. 2 is a circuit schematic illustration of the lighting system including power supply operation of the microcontroller to be implemented within the lighting system according to one or more exemplary embodiments.

FIG. 2 is a circuit schematic illustration of the lighting system 100 including power supply operation of the microcontroller 122 to be implemented within the lighting system 100 according to one or more exemplary embodiments.

As shown in FIG. 2, the microcontroller 122 is connected to the control system 110 and receives a standby signal ("STBY") via an input pin thereof as shown and the microcontroller 122 controls the power stage controller 125 by putting a predetermined voltage level e.g., approximately 5 volts (V) on the standby signal ("STANDBY") input at the power stage controller 125, to control the voltage thereto. Therefore, when standby mode of the lighting elements 130 (as depicted in FIG. 1) is initiated, the lighting driver 120 remains in a low consumption mode. During this low power consumption mode the lighting driver 120 must be able to continue to receive and transmit messages to and from the control system. For example, if when in a standby mode, the control system 110 then sends a message to the lighting driver 120 to change the operating mode of the lighting elements 130 from standby mode to on mode, then the lighting driver 120 can still receive messages from the control system 110 and control the lighting elements 130 accordingly.

In the event of the reception of a controller message during standby mode, the microcontroller 122 is also configured to initiate a burst mode to allow the microcontroller to draw more power to process and transmit any necessary data. Additional details regarding the burst modes of the microcontroller 122 will be described below with reference to FIG. 3.

Figure 3:
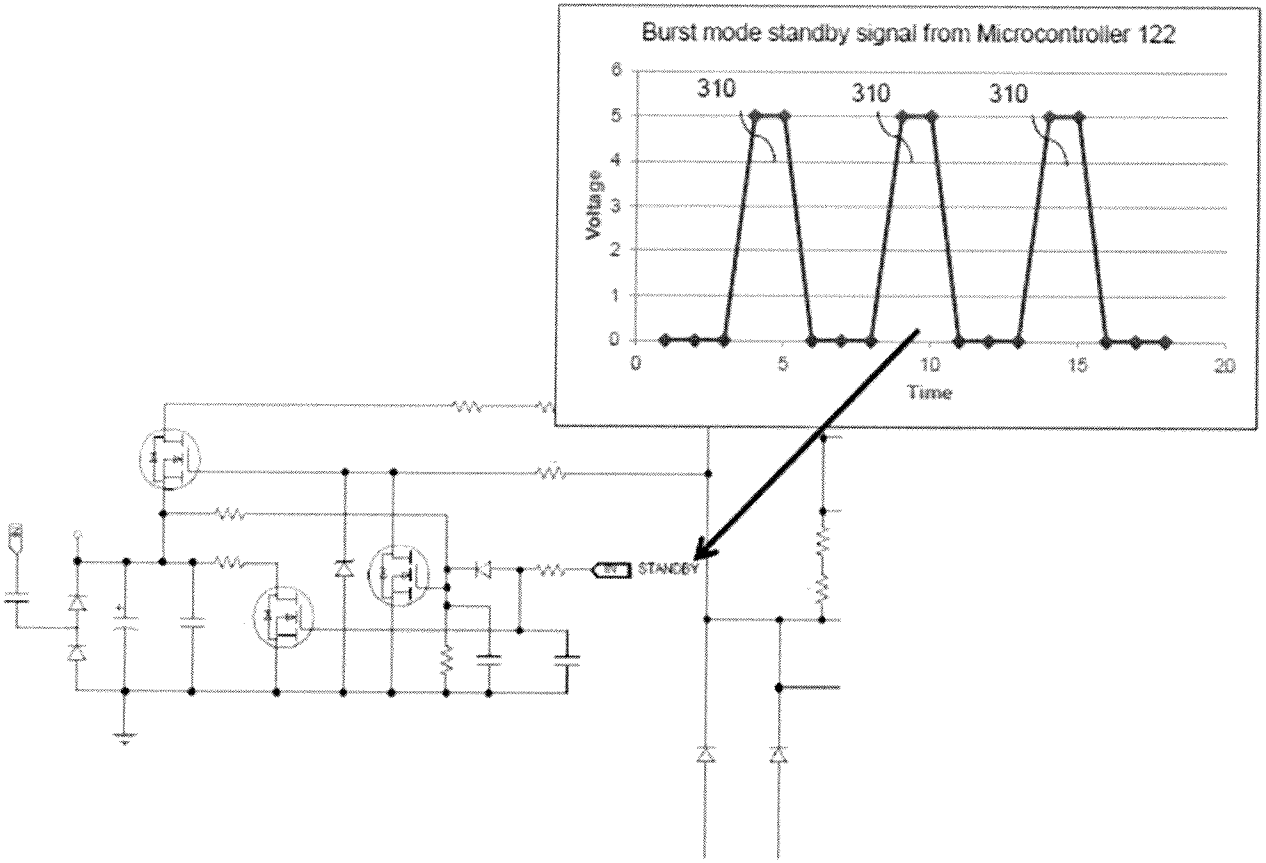
FIG. 3 is a graph illustration showing periodic burst modes of the microcontroller for maintaining a predetermined voltage level thereof according to one or more exemplary embodiments.

FIG. 3 is a graph illustration 300 showing periodic burst modes 310 of the microcontroller 122 for maintaining a predetermined voltage level thereof according to one or more exemplary embodiments. Referring back to FIG. 2, at the input of the circuit 125, the microcontroller 122 is configured to pulsate on and off during receipt of the standby signal (STANDBY) for specified periods of time to allow the microcontroller 122 to draw more power during the specified periods of time, without initiating an on mode of the lighting elements 130. For example, the voltage is pulsating from 0 volts (V) to 5 volts (V) and back to 0 volts (V) repeatedly during specified periods of time such as 5 ms to 10 ms intervals. Therefore, circuit 125 includes a lag time period, in order to prevent it from initiating an on mode of the lighting elements 130 during the burst modes 310 (as depicted in FIG. 3) of the microcontroller 122 shown in FIG. 2.

Figure 4:
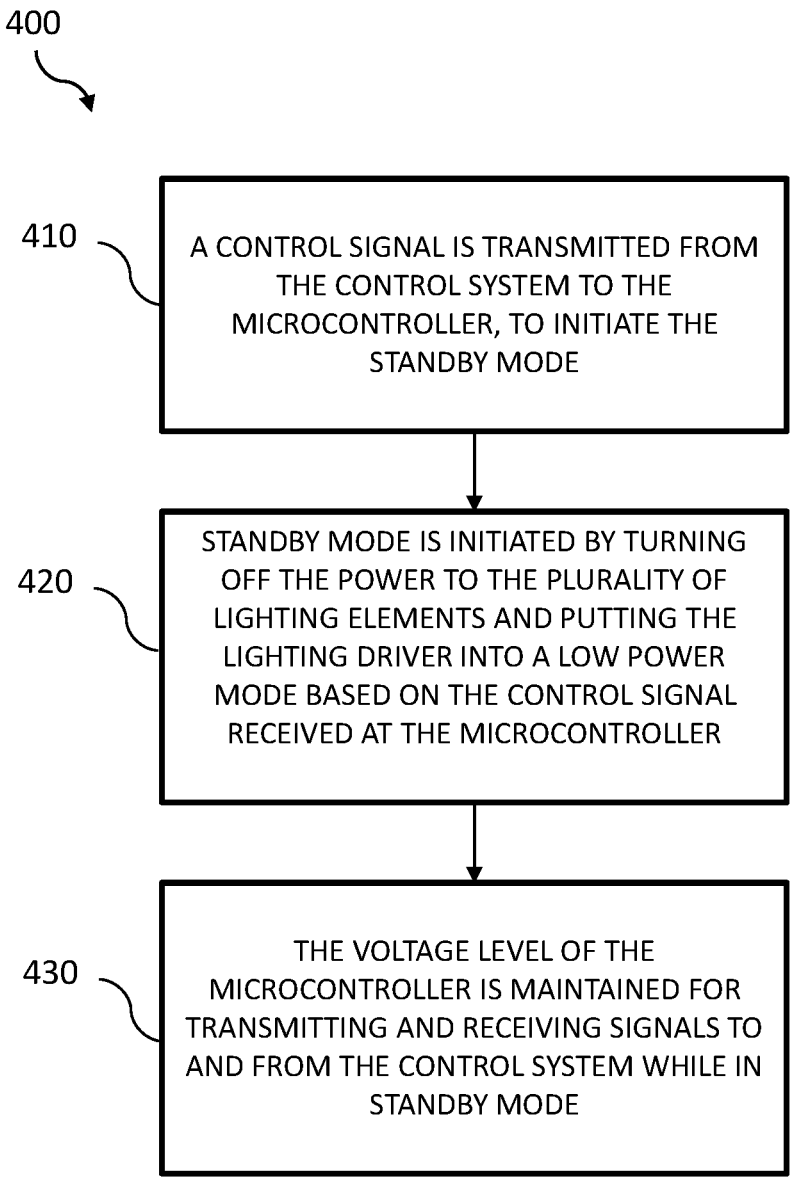
FIG. 4 is a flow diagram of an exemplary method for maintaining voltage supply to the microcontroller during standby mode of the lighting system according to one or more other exemplary embodiments.

FIG. 4 is a flow diagram of an exemplary method 400 for maintaining voltage supply to the microcontroller 122 during standby mode of the lighting system 100 according to one or more other exemplary embodiments.

In step 410, a control signal is transmitted from the control system to the microcontroller, to initiate the standby mode.

From step 410, the process continues to step 420, where standby mode is initiated by turning off the power to the plurality of lighting elements and putting the lighting driver into a low power mode based on the control signal received at the microcontroller. From the step 420, the process continues to step 430, where voltage level of the microcontroller is maintained for transmitting and receiving signals to and from the control system while in standby mode.

According to one or more exemplary embodiments, the voltage level of the microcontroller is maintained by performing the burst modes of a specified time period as shown in FIG. 3. The voltage is pulsating from 0 volts (V) to 5 volts (V) and back to 0 volts (V) repeatedly during a specified period of time such as 5 ms to 10 ms intervals. The specified period of time does not exceed the amount of time to bring the lighting elements back into "on" mode. That is, the bursts occur during specified time periods short enough to prevent the lighting driver from responding fast enough to turn the lighting elements back on, while still allowing the power supply at the microcontroller to be maintained, to facilitate receiving and transmitting of messages during standby mode.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A lighting system comprising:

a plurality of lighting elements configured to emit light, a power supply configured to supply power, a lighting driver comprising a microcontroller and configured to output power to the plurality of lighting elements for operation thereof; and a control system configured to transmit a control signal to the microcontroller to initiate a standby mode of the plurality of lighting elements, wherein the microcontroller is configured to receive the control signal and decrease output power supplied to the plurality of lighting elements, wherein the microcontroller is configured to pulsate on and off during receipt of the standby signal for specified periods of time, drawing an increase in power at the microcontroller during the specified periods of time, while remaining in a low power consumption mode for communicating with the control system during standby mode.

2. The lighting system of claim 1, wherein the control system is further configured to control an operational mode of the plurality of lighting elements, and the microcontroller receives and transmits messages with the control system during standby mode.

3. The lighting system of claim 1, wherein the power supply is configured to supply alternate current (AC) power to the lighting driver, for operating the plurality of lighting elements.

4. The lighting system of claim 1, wherein the microcontroller is programmable.

5. The lighting system of claim 1, wherein the microcontroller is configured to pulsate on and off by operating in a burst mode including a plurality of bursts occurring during the specified periods of time while the plurality of lighting elements are in standby mode.

6. The lighting system of claim 5, wherein the burst mode is configured to increase power to be supplied to the microcontroller during standby mode when communicating with the control system.

7. The lighting system of claim 5, wherein the specified periods of time are shorter than an amount of time for turning the plurality of lighting elements from standby mode into an "on" mode.

8. The lighting system of claim 5, wherein the lighting driver further comprises a circuit controllable by the microcontroller, and configured to receive a predetermined voltage level from the microcontroller during the burst mode of the microcontroller.

9. A method comprising:

outputting power to a plurality of lighting elements within a lighting system;

transmitting a control signal from a control system to a microcontroller of a lighting driver, to initiate the standby mode;

initiating the standby mode by decreasing, via the microcontroller, the power to the plurality of lighting elements, and pulsating the microcontroller on and off during receipt of the standby signal for specified periods of time, drawing an increase in power at the microcontroller during the specified periods of time, while remaining in a low power consumption mode for communicating with the control system during standby mode.

10. The method of claim 9, further comprising:

controlling an operational mode of the plurality of lighting elements; and receiving and transmitting messages between the microcontroller and the control system during standby mode.

11. The method of claim 9, wherein pulsating, the microcontroller, on and off during receipt of the standby signal further comprises:

controlling a voltage level of the microcontroller for maintaining communication with the control system during standby mode.

12. The method of claim 11, wherein controlling the voltage level comprises:

initiating a burst mode of the microcontroller during standby mode of the lighting system.

13. The method of claim 12, wherein the burst mode includes a plurality of bursts occurring during the specified periods of time while the plurality of lighting elements are in standby mode.

14. The method of claim 13, wherein the specified periods of time are shorter than an amount of time for turning the plurality of lighting elements from standby mode into an "on" mode.

15. The method of claim 12, further comprising:

receiving a predetermined voltage at a circuit controlled by the microcontroller, during the burst mode of the microcontroller; and communicating via the microcontroller, with the control system during the standby mode, using the predetermined voltage.

16. The method of claim 9, wherein the microcontroller is programmable.

* * * * *